US006691826B1

(12) United States Patent
Dean

(10) Patent No.: US 6,691,826 B1
(45) Date of Patent: Feb. 17, 2004

(54) SAFETY APPARATUS

(75) Inventor: John Lawrence Dean, Burleigh Heads (AU)

(73) Assignee: MSPH PTY LTD (AU)

( * ) Notice: Subject to any disclaimer, the term of this patent is extended or adjusted under 35 U.S.C. 154(b) by 0 days.

(21) Appl. No.: 10/069,739

(22) PCT Filed: Nov. 9, 1999

(86) PCT No.: PCT/AU99/00986

§ 371 (c)(1),
(2), (4) Date: Feb. 25, 2002

(87) PCT Pub. No.: WO00/45012

PCT Pub. Date: Aug. 3, 2000

(30) Foreign Application Priority Data

Jan. 29, 1999 (AU) ..... PP 8388

(51) Int. Cl.[7] ..... A47L 3/02; E04G 1/16

(52) U.S. Cl. ..... 182/113; 182/3; 256/DIG. 6

(58) Field of Search ..... 182/3, 113, 36, 182/4, 112, 45; 52/125.4, 127.2, 127.1, 736.1; 256/DIG. 6, DIG. 5, 59, 65, 67, 32

(56) References Cited

U.S. PATENT DOCUMENTS

| | | | | |
|---|---|---|---|---|
| 3,880,405 A | | 4/1975 | Brueske | |
| 3,920,221 A | | 11/1975 | Berry et al. | |
| 4,037,824 A | | 7/1977 | Whitmer | |
| 4,480,819 A | * | 11/1984 | Lopez | 182/113 X |
| 5,029,670 A | * | 7/1991 | Whitmer | 182/113 |
| 5,307,897 A | * | 5/1994 | Turner et al. | 182/3 |
| 5,718,305 A | | 2/1998 | Palmer | |
| 6,053,281 A | * | 4/2000 | Murray | 182/113 |
| 6,173,809 B1 | * | 1/2001 | Cole et al. | 182/3 |

FOREIGN PATENT DOCUMENTS

| | | |
|---|---|---|
| DE | 3201582 A | 7/1983 |
| GB | 2 253 877 | 9/1992 |
| GB | 2 299 827 | 10/1996 |
| GB | 2319286 A | 5/1998 |
| JP | 08257151 | 10/1996 |

* cited by examiner

*Primary Examiner*—Alvin Chin-Shue
*Assistant Examiner*—Hugh B. Thompson
(74) *Attorney, Agent, or Firm*—Jason A. Bernstein; Powell, Goldstein, Frazer & Murphy LLP

(57) ABSTRACT

A safety apparatus (10) for enhancing worker safety includes a support arrangement. The arrangement is locatable proximate a hazardous working area (18). A connecting arrangement defines at least one pair of opposed connecting points (64). The connecting points (64) are positioned on opposite sides of the hazardous area (18) so that a line (72) connecting the points (64) spans the hazardous area (18). The invention extends to an anchor member (12) for the safety apparatus, to a kit for the safety apparatus and to a structural assembly.

8 Claims, 8 Drawing Sheets

SAFETY APPARATUS

This application is a continuation of PCT/AU99/00986, filed Nov. 9, 1999.

This invention relates to worker safety. In particular, this invention relates to a safety apparatus for enhancing worker safety, a kit for a safety apparatus for enhancing worker safety, an anchor member of a safety apparatus for enhancing worker safety, a structural assembly and a method of enhancing worker safety.

Construction workers are often in a position in which they work at elevated locations. It is well known for such workers to utilise various safety arrangements in order to prevent death or injury.

An example of such an arrangement is where the worker is attached to part of a structure via a suitable harness and safety line. This can result in a substantial amount of inconvenience and aggravation for the worker. A particular problem which occurs is that the safety line often becomes entangled and generally obstructive.

As a result, many construction workers are loath to use such safety equipment. Furthermore, the obstructions and entanglements themselves create dangerous working conditions.

It is to be appreciated that it would be desirable for a means to be provided whereby these problems are overcome.

According to a first aspect of the invention, there is provided a safety apparatus for enhancing worker safety, the apparatus including, a support arrangement that is locatable proximate a hazardous working area; and a connecting arrangement that defines at least one pair of opposed connecting points, the connecting points of the, or each, pair being positioned on opposed sides of the hazardous area so that a line connecting the points spans the hazardous area.

The support arrangement may be mountable on a structure that defines the hazardous working area.

The support arrangement may include at least two support posts that are mounted on an overhead structure to extend upwardly from the overhead structure. In particular, a number of support posts may be mounted on the overhead structure such that a network of safety lines can be positioned above the overhead structure.

Each support post may include a rod that has a base fixed to a lower end thereof. The base may include a base plate and stablising web members. The base plate and the web members may be fixed to the lower end of the rod.

The safety apparatus may include a number of fastening arrangements to permit each support post to be fastened to a beam of the overhead structure. Each fastening arrangement may be in the form of a clamping device to permit each base to be clamped to the beam.

The connecting arrangement may include a connecting formation positioned on an upper end of each rod. Each connecting formation may be configured to permit at least one line to be attached to each connecting formation.

Each connecting formation may be in the form of a number of projections extending laterally from the upper end of each rod. Each projection may have an opening defined therein to permit an end of a line to be connected to each projection.

Each support post may be of sufficient length to facilitate movement of workers beneath safety lines connected between the support posts.

According to a second aspect of the invention, there is provided an anchor member for a safety apparatus for enhancing worker safety, the anchor member including an elongate support post that has a lower end that is fastenable to a structure so that the support post extends upwardly from the structure, in use; and a connecting arrangement positioned at an upper end of the support post to permit an end of a safety line to be connected to the support post.

A base may be fixed to the lower end of the support post, the base being fastenable to the structure. The base may include a base plate that is fixed to the lower end of the support post.

The anchor member may be substantially the same as that of the anchor member of the first aspect of the invention.

According to a third aspect of the invention, there is provided a kit for a safety apparatus for enhancing worker safety, the kit including at least two support posts that are mountable on a structure that defines a hazardous working area to extend upwardly from the support structure; and a connecting arrangement that is positioned on each support post to permit an end of the safety line to be connected to each support post so that the safety line spans the hazardous area.

The support posts and the connecting arrangements of the kit may be those described in the first aspect of the invention.

According to a fourth aspect of the invention, there is provided a structural assembly which includes a structure having an overhead portion that defines a hazardous working area;

a support arrangement that is mounted on the overhead portion of the structure at least proximate the hazardous working area; and a connecting arrangement that defines at least one part of opposed connecting points, the connecting points of the, or each, pair being positioned on opposed sides of the hazardous area so that a line connecting the points spans the hazardous area.

According to a fifth aspect of the invention, there is provided a method of enhancing worker safety, the method including the steps of mounting a support arrangement having a connecting arrangement that defines at least one pair of opposed connecting points, so that a connecting point is positioned on each side of a hazardous area defined by the support arrangement.

The method may include connecting an end of a safety line to each respective connecting point so that at least one safety line spans the hazardous area.

The method may further include mounting a number of support posts on the overhead portion of the structure, each support post defining at least one connecting point.

Each support post may be detachably mounted to the overhead portion of the structure. Thus, each support post may be removed from the structure after use.

Instead, the support posts may be permanently mounted on the overhead portion of the structure. Thus, the support posts can form an integral part of a finished structure.

A safety apparatus in accordance with this invention may manifest itself in a variety of forms. It will be convenient hereinafter to describe in detail preferred embodiments of the invention with reference to the accompanying drawings. The purpose of this specific description is to instruct persons having an interest in the subject matter of the invention how to carry the invention into practical effect. It is to be clearly understood however that the specific nature of this description does not supersede the generality of the preceding broad description. In the drawings.

Figure 1:
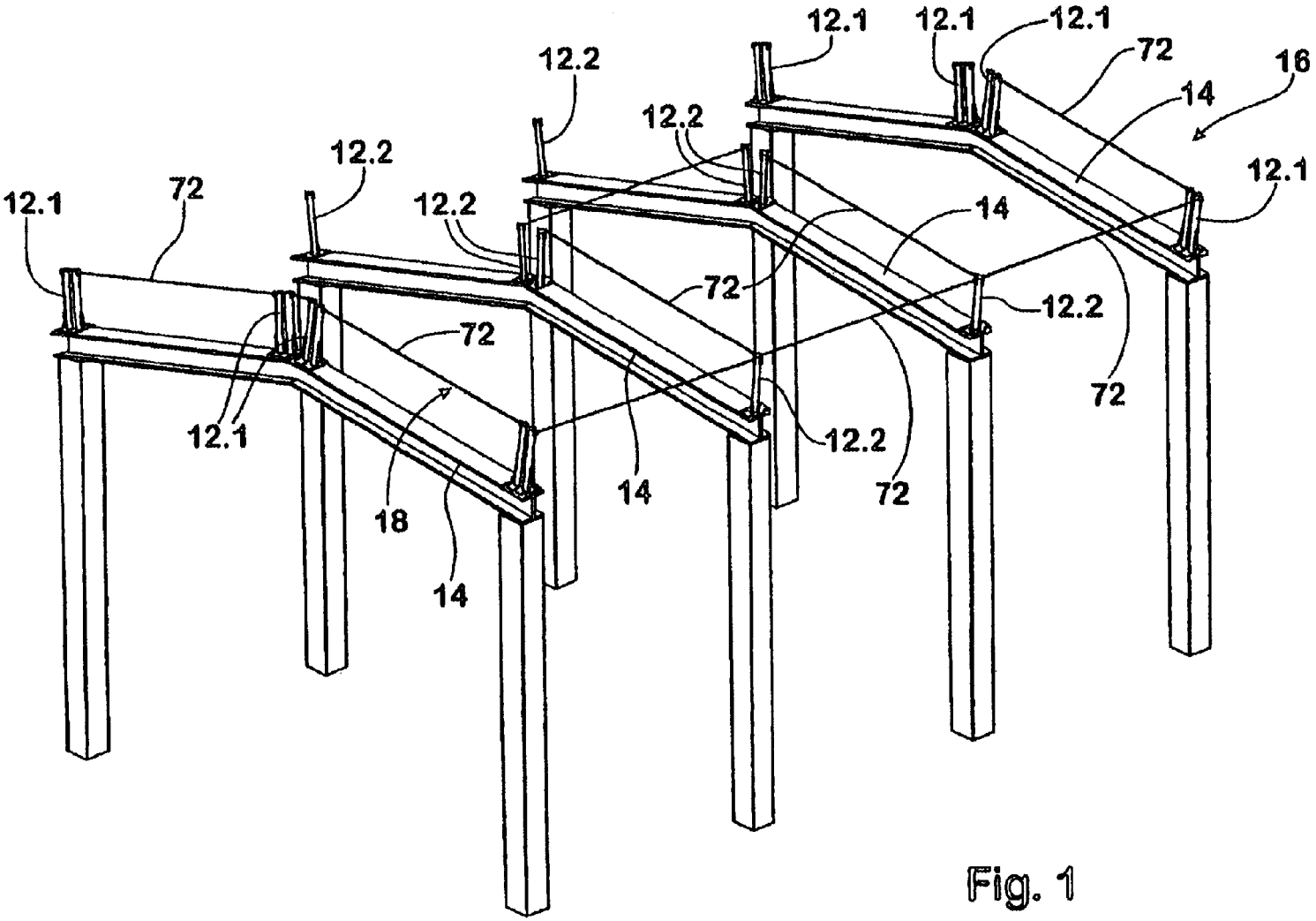
FIG. 1 shows a three dimensional view of a safety apparatus, in accordance with the invention for enhancing worker safety.
Figure 2:
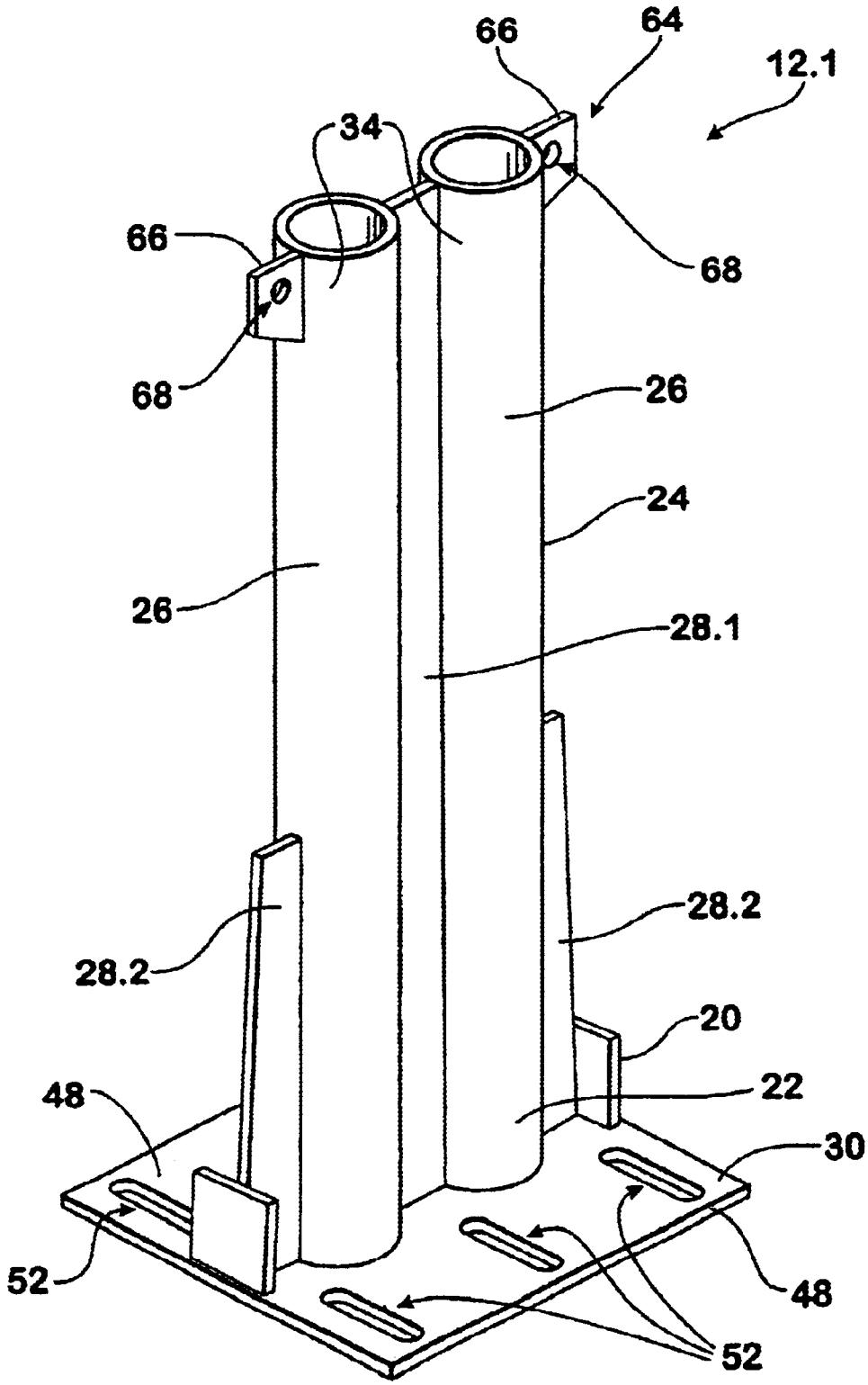
FIG. 2 shows a three dimensional view of a primary anchor member of the safety apparatus.
Figure 3:
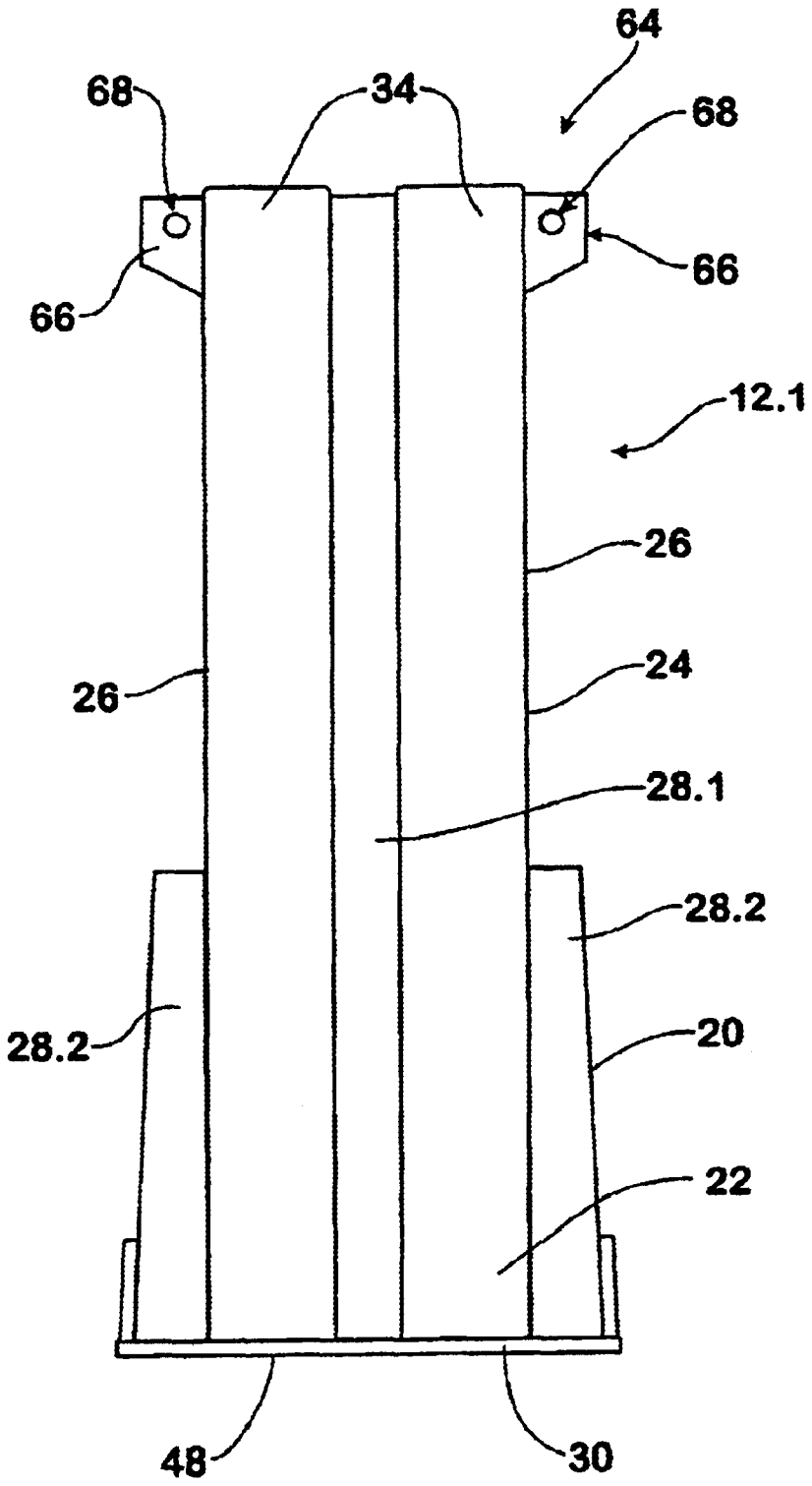
FIG. 3 shows a side view of the primary anchor member.
Figure 4:
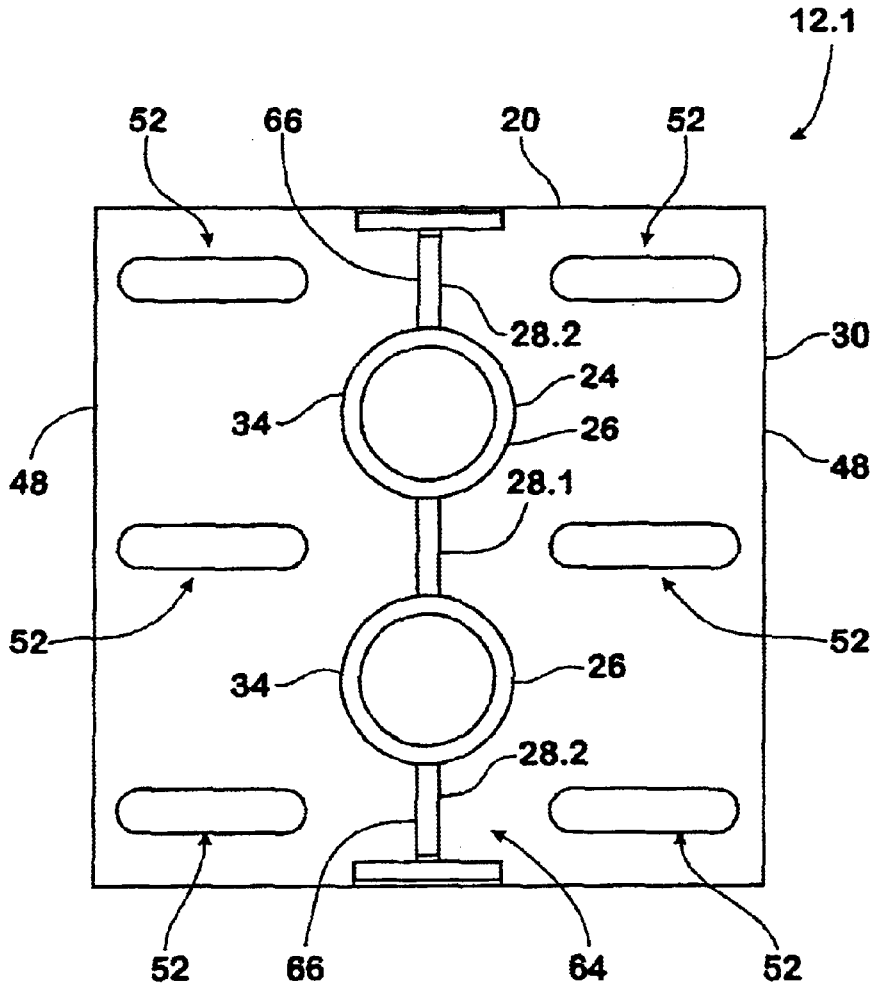
FIG. 4 shows a top plan view of the primary anchor member.

In FIG. 1, reference 10 generally indicates a safety apparatus, in accordance with the invention, for enhancing worker safety.

The safety apparatus 10 includes a support arrangement in the form of a plurality of anchor members 12.

The anchor members 12 are fastened to beams 14 of a structure 16.

The beams 14 of the structure 16 define a hazardous working area 18. The anchor members 12 therefore extend upwardly from the beams 12 into the hazardous working area 18.

Each anchor member 12 includes a base 20 fixed to a lower end 22 of a support post 24. The anchor members 12 are divided into a group of primary anchor members 12.1 and a group of intermediate anchor members 12.2.

The support post 24 of each primary anchor member 12.1 includes a pair of elongate tubular members or tubes 26. The tubes 26 are positioned side-by-side. Each tube 26 is circular cylindrical.

The support post 24 of the primary anchor member 12.1 includes three web members 28. The web members 28 comprise an intermediate web member 28.1 that is positioned between the tubes 26 and extends along the length of the tubes 26.

An outer web member 28.2 is connected to each respective tube 26. The web members 28 are fixed to the tubes 26 and to a base plate 30 of the base 20. The beams 14 of the structure 16 are in the form of I-beams.

The base plate 30 of each primary anchor member 12.1 is clamped to a flange 36 of an I-beam 14.

Thus, the safety apparatus 10 includes a number of clamping arrangements 38. Each clamping arrangement 38 includes a clamping plate 40 and a cylindrical spacer 42 mounted on the clamping plate 40. The cylindrical spacer 42 is in the form of a cylindrical rod 44 fixed to the clamping plate 40.

Each clamping plate 40 has a pair of aligned openings 44 defined therein. Each clamping plate 40 has a clamping region 46 positioned on one side of the openings 44 with the cylindrical rod 42 positioned on an opposed side of the openings 44 in spaced, parallel relationship to the openings 44.

In use, the base plate 30 is positioned on a respective flange 36. The base plates 30 are dimensioned so that sides 48 extend beyond edges 50 of the flange 36. The base plate 30 has a number of slotted openings 52 defined therein. The slotted openings 52 are positioned on each side of the tubes 34, with each opening extending away from the tubes 34 towards the edges 50 of the flange 36.

The slotted openings 52 are configured so that, when the base plate 30 is positioned on the flange 36, the slotted openings 52 are accessible from beneath the flange 36. Thus, the clamping plate 40 is designed so that when the clamping region 46 bears against a lower side 54 of the flange 36, the openings 44 are aligned with respective slots 52. Further, the cylindrical spacer 42 is dimensioned and positioned to bear against the base plate 30. A bolt 56 of the bolt and nut combination 58 is received through each opening 44 and each slotted opening 52. A nut 60 and washer 62 are screwed onto each bolt 56 so that the flange 50 is clamped between the base plate 30 and the clamping plate 40. It will be appreciated that the cylindrical spacer 42 provides pivotal clamping action to enhance the clamping effect. Further, the fact that the openings 52 are slotted permits adjustment of the position of each anchor member 12.1 relative to its respective beam 14.

It will readily be appreciated that, where a permanent fastening arrangement is desired, complementary openings can be provided between the clamp plates 40, the flange 36 and the base plate 30 so that a bolt can be received therethrough. However, in this case, the clamping arrangements 38 provide the facility whereby the anchor members 12 can be removed without affecting the integrity of the beams 14.

The clamping plate 40 is shown in this particular example as having two openings 44. This particular clamping plate 40 is intended to be used with the intermediate anchor member 12.2 described below. However, it will readily be appreciated that the clamping plate 40 will have three openings 44 to correspond with the three slotted openings 52 positioned on each side of the tubes 26.

The safety apparatus 10 includes a connecting arrangement in the form of connecting formations 64 positioned on the upper ends 34 of the tubes 26. Each connecting formation 64 is in the form of a lug 66 which extends radially from each tube 26. Each lug 66 has an opening 68 defined therein. An end 70 of a safety line 72 is fastenable to each lug 66 via the opening 68. This fastening can take any desired form such as a suitable clip.

Figure 5:
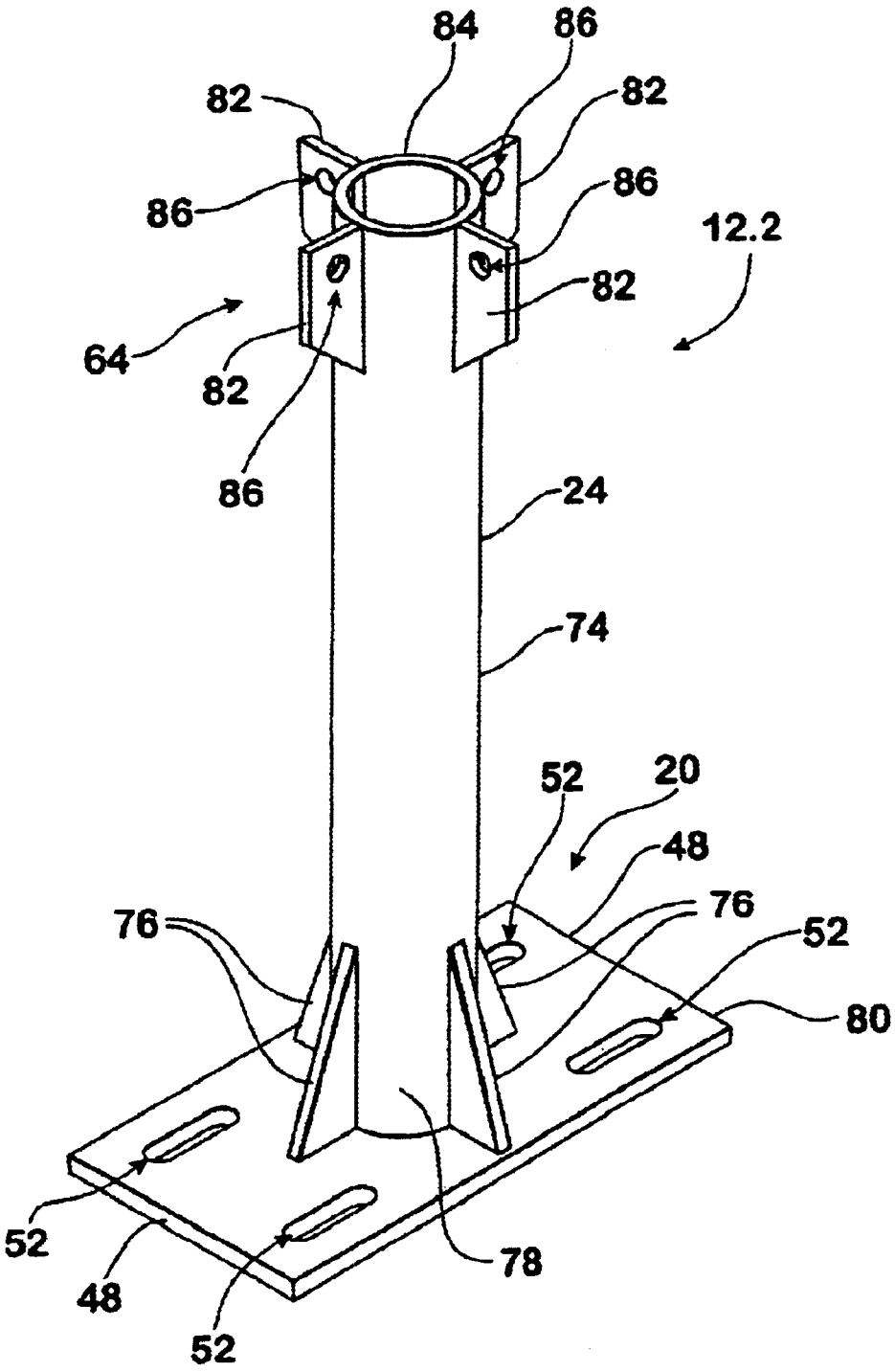
FIG. 5 shows a three dimensional view of an intermediate anchor member of the apparatus.
Figure 6:
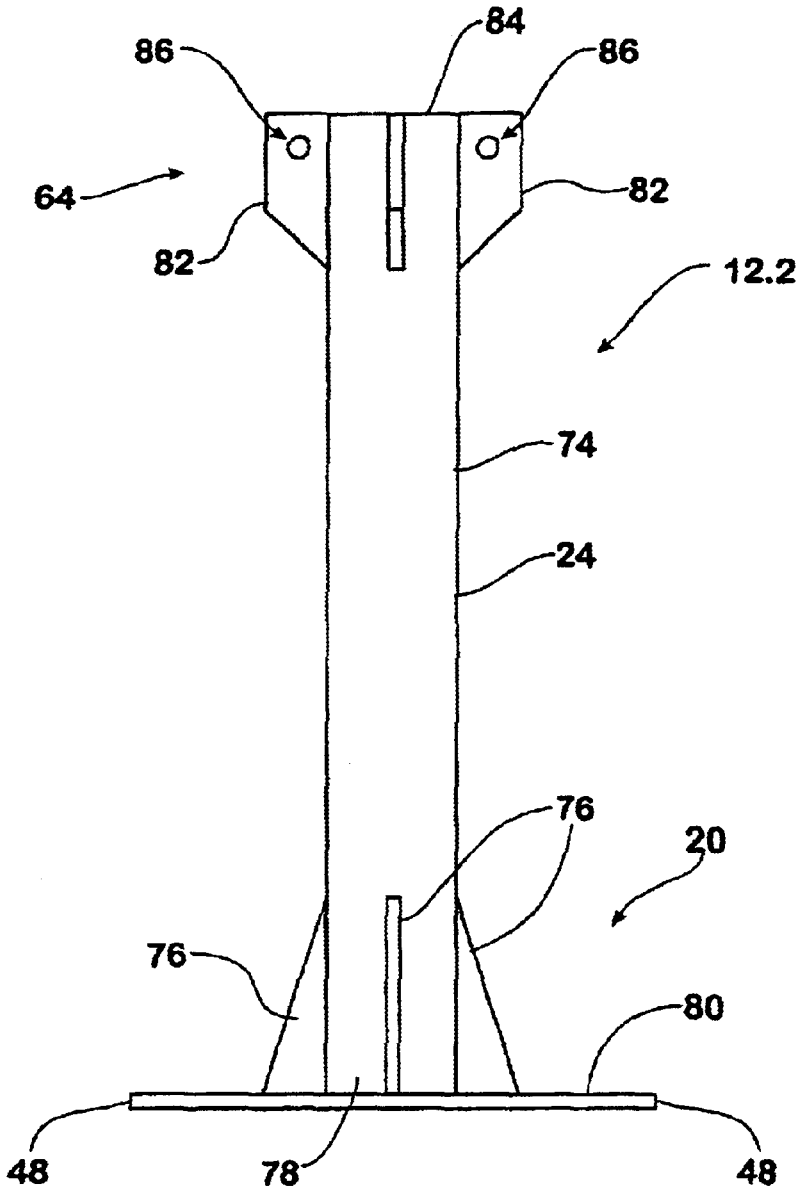
FIG. 6 shows a side view of the intermediate anchor member.
Figure 7:
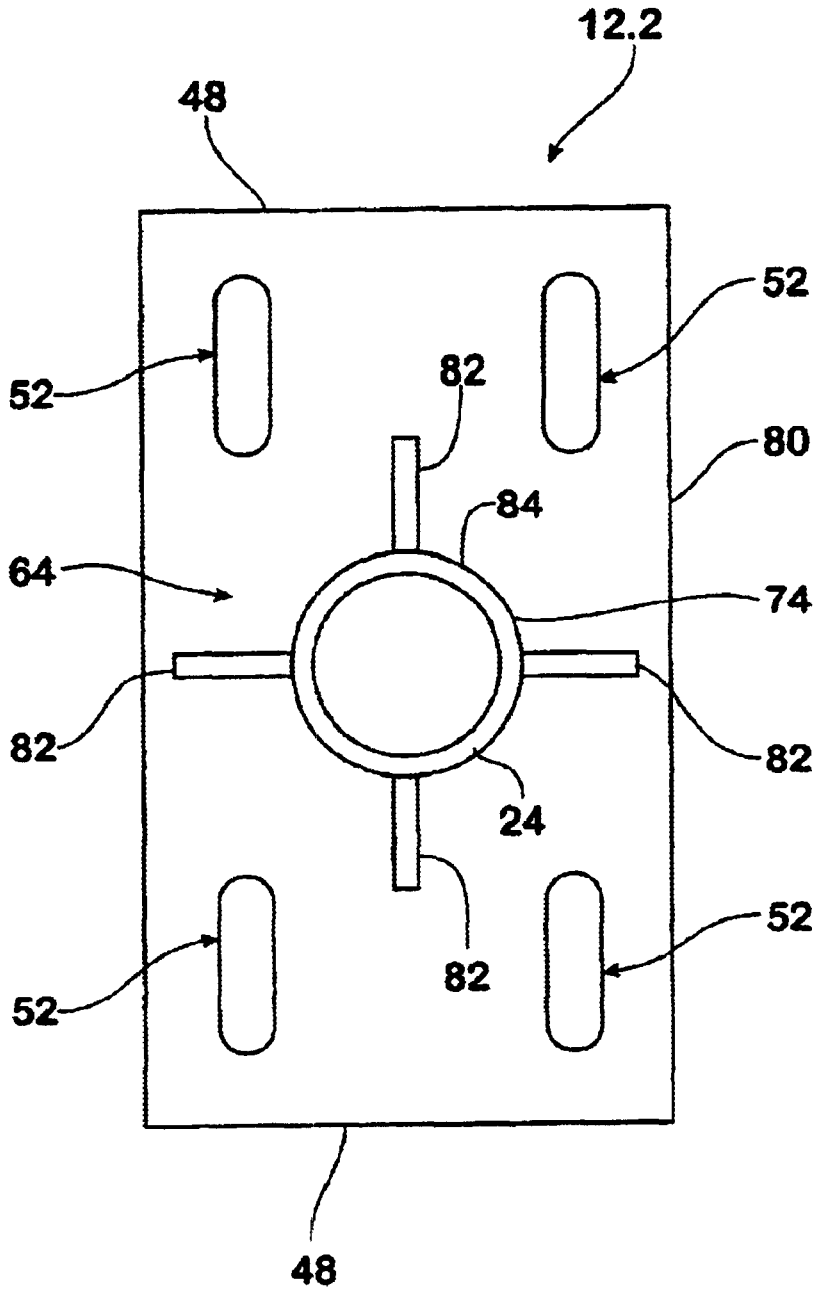
FIG. 7 shows a top plan view of the intermediate anchor member.
Figure 8:
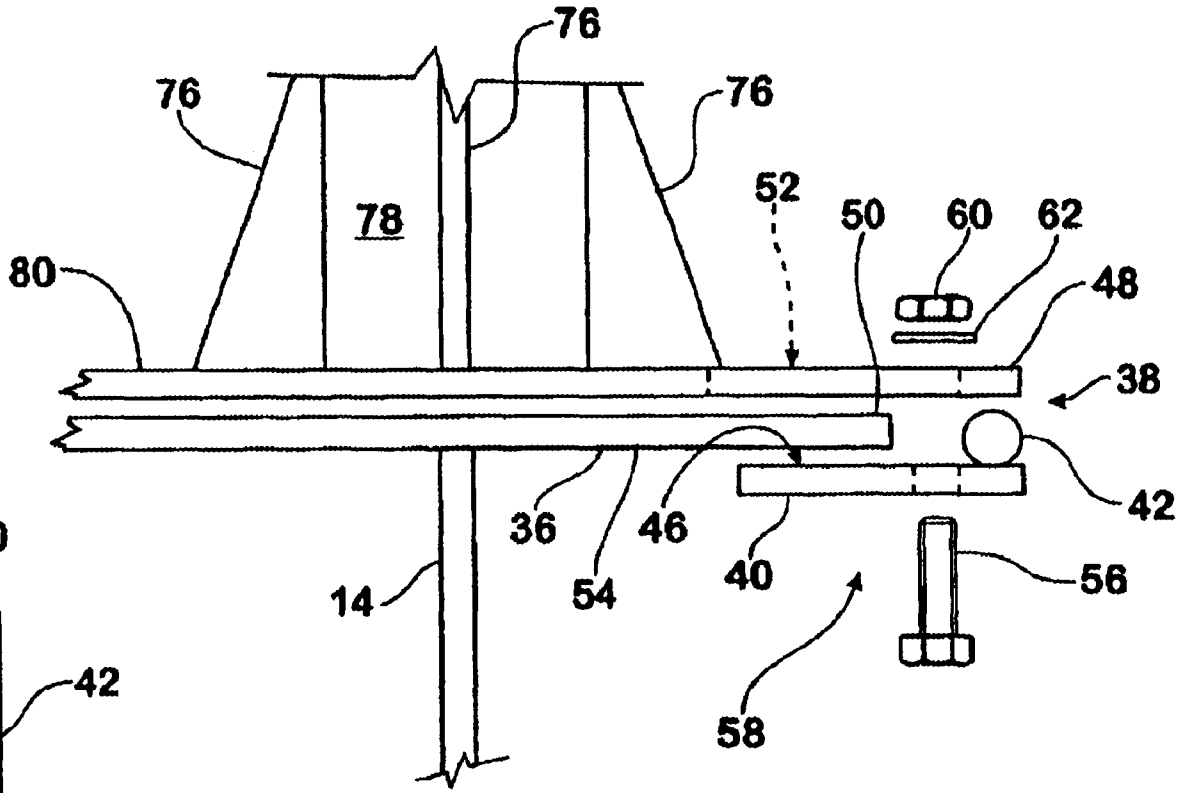
FIG. 8 shows a side view of a clamping arrangement of the safety apparatus.
Figure 9:
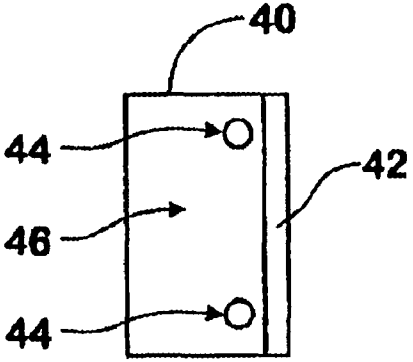
FIG. 9 shows a top plan view of a clamping plate of the clamping arrangement.

In FIG. 5, there is shown an intenmediate anchor member 12.2. The support post 24 of the anchor member 12.2 includes a single tube 74. Four equally spaced and radially extending web members 76 are fixed to a lower end 78 of the tube 74. The lower end 78 and the web members 76 are fixed to a base plate 80. The base plate 80 also has the slotted openings 52. Thus, the base plate 80 is clamped to the beams 14 in a similar manner as is the base plate 30. Four equally spaced radially extending lugs 82 are fixed to an upper end 84 of the tube 74. Each lug 82 has an opening 86 defined therein. As before, an end 70 of a safety line 72 can be connected to either of the lugs 82 via its respective opening 86.

In use, a plurality of the anchor members 12 are clamped to the beams 14 of the structure 16. A particular arrangement is shown in FIG. 1. Safety lines 72 are connected between various anchor members to define a network of safety lines 72.

A worker positioned in the hazardous working area 18 wears a safety harness with a safety lead extending therefrom. The safety lead can have a running clip fixed thereto, as is common in the field. The running clip can be clipped to any of the safety lines 72 to move along the safety lines as the worker moves within the hazardous working area 18.

Each anchor member 12 is approximately 1.8 metres high. This serves to keep the safety lead out of the way of the worker and therefore prevents entanglements and dangerous situations from arising.

It will readily be appreciated that the primary anchor member 12.1 is of greater strength than the intermediate anchor members 12.2. It follows that the primary anchor members 12.1 are fastened to the beams 14 in positions where the greater amount of force would be generated should a worker slip and be suspended from one of the safety lines 72.

The applicant believes that the safety apparatus 10 provides a means whereby worker safety in a hazardous area is greatly enhanced. The fact that the safety leads are connected displaceably to a point at head height or above, permits a worker to move about freely in the hazardous area without unnecessary entanglements and inconvenience. Still further, the position of the safety lines 72 is such that should a walker slip, the amount of shock generated by the resultant tautening of the safety lead is reduced. This will be appreciated when one considers what the consequence would be should the safety lead be connected to a point at a worker's feet. A further convenient aspect of this invention is that the safety apparatus 10 can be installed either temporarily or permanently. Where the safety apparatus 10 is installed permanently, the safety apparatus 10 forms part of the structure.

In conclusion, the applicant believes that this invention provides an apparatus for enhancing worker safety which has significant advantages over presently available safety configurations.

It will of course be realised that the above has been given only by way of illustrative example of the invention and that all such modifications and variations thereto as would be apparent to persons skilled in the art are deemed to fall within the broad scope and ambit of the invention as is herein set forth.

The claims defining this invention are as follows:

1. A safety apparatus, comprising:

a.) at least one primary anchor comprising, i.) a first base plate having at least one opening, ii.) a pair of tubes in a side-by-side arrangement vertically extending from and attached to said first base plate, each said tube having an upper end and a lower end, iii.) a plurality of web members comprising, a) an intermediate web member connecting said pair of tubes and also attached to said first base plate, and b) a plurality of outer web members connecting each said tube to said first base plate, iv.) at least one first lug associated with said upper end of each said tube, each lug having an aperture defined therein;

b.) at least one intermediate anchor comprising, i.) a second base plate having a plurality of openings, ii.) a tube extending vertically from and attached to said second base plate, iii.) a plurality of web members connecting said tube to said second base plate, iv.) at least one second lug associated with said upper end of said tube, each lug having an aperture defined therein;

said at least one primary anchor and said at least one intermediate anchor being mountable to a support structure comprising a plurality of generally horizontal beams, said generally horizontal beams being associated with a plurality of vertical support beams, said first and second lugs being connectable to at least one safety line.

2. The apparatus of claim 1, further comprising a clamping device.

3. The apparatus of claim 2, wherein said clamping device comprises at least one bolt, nut and spacer.

4. The apparatus of claim 3, wherein said spacer comprises a plate having at least one aperture defined therein, and a bead extending from the face of said plate.

5. The apparatus of claim 1, comprising at least one safety wire.

6. The apparatus of claim 1, wherein said support structure comprises a framework of vertical beams and generally horizontal beams laid out in a generally rectangular arrangement having a plurality of corner areas, and wherein said at least one primary anchor comprises a plurality of primary anchors, said at least one intermediate anchor comprises a plurality of intermediate anchors and wherein said primary anchors are mounted to said beams at said corners and said intermediate anchors are mounted to said beams between said corners.

7. The apparatus of claim 1, wherein said first base plate openings are slots.

8. The apparatus of claim 1, wherein said second base plate openings are slots.

* * * * *